US007966756B1

(12) United States Patent
Stafford

(10) Patent No.: US 7,966,756 B1
(45) Date of Patent: Jun. 28, 2011

(54) ILLUMINABLE ADDRESS DISPLAY SYSTEM AND ASSOCIATED METHOD

(76) Inventor: Lorena Stafford, San Bernardino, CA (US)

( * ) Notice: Subject to any disclaimer, the term of this patent is extended or adjusted under 35 U.S.C. 154(b) by 263 days.

(21) Appl. No.: 12/284,729

(22) Filed: Sep. 24, 2008

Related U.S. Application Data

(60) Provisional application No. 60/994,808, filed on Sep. 24, 2007.

(51) Int. Cl.
*G09F 13/22* (2006.01)

(52) U.S. Cl. ..... 40/544; 40/605

(58) Field of Classification Search ..... 40/605, 40/544; 439/1, 6, 505; 362/391, 249.04, 362/249.03, 249.07, 249.08, 249.14, 104, 362/427, 287

See application file for complete search history.

(56) References Cited

U.S. PATENT DOCUMENTS

| | | | | |
|---|---|---|---|---|
| 4,654,766 | A * | 3/1987 | Tung | 362/249.14 |
| 5,020,253 | A * | 6/1991 | Lie et al. | 40/576 |
| 5,522,540 | A | 6/1996 | Surman | |
| 5,778,579 | A | 7/1998 | Yuen | |
| 6,299,325 | B1 * | 10/2001 | Cathel | 362/183 |
| 2006/0034066 | A1 * | 2/2006 | Chang | 362/104 |

* cited by examiner

*Primary Examiner* — Joanne Silbermann

(57) ABSTRACT

The illuminable address display system may include mobile support blocks adjustably connected to each other. An anterior side of each support block may have an illuminable transparent number. The system may further include a plurality of conductive cords, with ball bearings attached directly to first and second opposed ends. The cords may adjustably connect adjacent support blocks and the first conductive cord may connect to a power source. Each support block perimeter may also includes a track with a plurality of sockets running along the thereof. A conductive coupling may be seated within each support block and electronically coupled to the track. The conductive couplings transmit electricity from the power source, along adjacent conductive cords, and to a light-emitting member in each support block. A controller may be coupled to the conductive cords for toggling each illuminable number into off or on modes.

10 Claims, 4 Drawing Sheets

ILLUMINABLE ADDRESS DISPLAY SYSTEM AND ASSOCIATED METHOD

CROSS REFERENCE TO RELATED APPLICATIONS

This application claims the benefit of U.S. Provisional Application No. 60/994,808, filed Sep. 24, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to address numbers and, more particularly, to an illuminable address display system for exhibiting a customized address number in a variety of orientations.

2. Prior Art

It is common practice for homeowners to display their address numbers on either their mail box, next to door, or both, so that visitors and the like can more easily locate their residence. At night however, this may be more difficult. It can be very difficult to legibly read the address numbers on mailboxes, or those displayed on the surface of a house, due to the absence of light. Even on well lit streets, it can be difficult to read the indicia stenciled on the mailbox or the numbers bolted to a wall in the vicinity of a front door. If the individual is driving a vehicle and there are other vehicles behind the lead vehicle, it quickly becomes dangerous to repeatedly slow down and speed up while attempting to locate the correct home or business.

Some have attempted to alleviate this dilemma by mounting indicia on a small illuminated box. These devices are typically staked into the ground near the entrance of the property. Unfortunately, such a device has inherent deficiencies. First and foremost, most people are not looking at the ground of the property but the mailbox or building itself in an attempt to locate a specific property. For that reason, many people merely overlook the small staked device. Further, such a device can be easily removed and therefore stolen or removed by vandals. Where two or more properties are closely located, someone searching for a particular home or business may become confused as to which property the small box is associated.

U.S. Pat. No. 5,522,540 to Surman discloses a solar powered illuminated address number and mailbox structure comprising a tray structure, a mailbox, a solar energy collector exteriorly mounted on the mailbox, a circuit connected to the solar energy collector including a battery, and an address number light display mounted on an exterior surface of the mailbox. The solar energy collector provides a power source and is connected through the circuit to charge the battery. The address number light display comprises a lighting means, an address display frame, a transparent display device, and reflective address numerals. The lighting means is attached to an exterior surface of the mailbox and electrically connected with the circuit means and powered by the battery. The address display frame has a fastening means for securing the address display frame to an exterior surface of the mailbox. Unfortunately, this prior art reference does not provide the user with a means of configuring the display numbers into alternate orientations.

U.S. Pat. No. 5,778,579 to Yuen discloses an interlocking display panel assembly comprising a pair of end elements for attachment to a supporting surface and at least one intermediate element having an indicia displaying surface locatable in an interlocking relationship between the end elements to form an integral planar assembly. Illumination devices are also included in the intermediate elements. Each element interlocks with an adjacent element by means of a tongue-and-groove arrangement. Male and female portions of the tongue-and-groove arrangements are on opposite sides of the intermediate elements being arranged in a complementary manner so that as many intermediate elements can be fitted together in a row as desired. Respective contacts are provided on opposing surfaces of adjacent interlocking elements so as to transfer electrical power between adjacent elements. One of the end elements includes a device for providing power to the assembly. Unfortunately, this prior art reference fails to provide a means of rotating the display numbers in relation to one another while the numbers remain illuminated.

U.S. Pat. No. 6,299,325 to Cathel discloses an illuminating mailbox address indication device including a generally rectangular shaped housing mounted on a top portion of a mailbox. Enclosed within the housing is a light means powered by a set of batteries which are rechargeable and energized by a solar cell mounted upon the housing. A photosensitive cell operates a switch to permit the light means to illuminate when a pre-determined threshold has been exceeded relevant to the amount of ambient light present around the mailbox. The housing walls are translucent and further include indicia stenciled thereupon which represent the address of the property associated with the mailbox. Unfortunately, this prior art reference does not provide a means of selectively toggling display numbers between illuminated and non-illuminated modes.

Accordingly, a need remains for an illuminated address sign in order to overcome the above-noted shortcomings. The present invention satisfies such a need by providing a system that is convenient and easy to use, is durable yet lightweight in design, is versatile in its applications, and provides a clearly visible display of a building or home's address, particularly at night and during inclement weather.

BRIEF SUMMARY OF THE INVENTION

In view of the foregoing background, it is therefore an object of the present invention to provide a system for exhibiting a customized address number in a variety of orientations. These and other objects, features, and advantages of the invention are provided by an illuminable address display system.

The illuminable address display system may include a plurality of uniquely shaped mobile support blocks adjustably connected to each other along a side-by-side orientation. Of course, such support blocks may be configured in alternate orientations, as explained below. Each of the mobile support blocks preferably includes an anterior side provided with a transparent number affixed thereto. The system may also include a plurality of conductive cords with first and second opposed ends adjustably connected to adjacent ones of the support blocks. A controller may be communicatively coupled to the conductive cords in such a manner that each of the numbers are simultaneously toggled between illuminated and non-illuminated modes based upon a corresponding user input at the controller.

Further, the system may include a mechanism for freely displacing the first and second opposed ends of the conductive cords along unique travel paths defined about respective perimeters of the support blocks so that the support blocks are freely positioned in alternate orientations while the numbers remain at the illuminated mode respectively. This enables a user to adapt the illuminable address display system to fit wide of areas. For example, the user may install the system vertically along a front porch support post, horizontally over a front door, or diagonally along an arching window.

Each of the support blocks preferably includes a power supply source electrically coupled to the controller respectively. Also, each of the support blocks may include a light-emitting member electrically coupled to the power supply source. Such a light-emitting member may be electrically engaged with a conductive coupling. Such a conductive coupling is preferably electrically engaged with adjacent ones of the conductive cords which is important such that power continuously transfers to adjacent ones of the light-emitting members while the adjacent conductive cords are displaced along the travel paths respectively.

The conductive cord displacing mechanism preferably includes a plurality of tracks formed about the perimeters of the support blocks respectively. A plurality of ball bearings may be attached directly to the opposed first and second ends of the conductive cords respectively such that a pair of ball bearings is simultaneously situated along each of the tracks. Each track preferably includes at least one ingress egress orifice which is important so that the user may detach the conductive cord from the supporting block by removing the ball bearing through the ingress egress orifice. Further, a plurality of sockets may be slidably connected to the tracks respectively such that a pair of the sockets is simultaneously positioned in each of the tracks. In this manner, the ball bearings may be rotatably interfitted within the sockets in such a manner that each of the conductive cords and the support blocks are synchronously displaced along the associated tracks respectively.

The conductive cord displacing mechanism may further include a plurality of conductive couplings situated within the support blocks respectively. Each of such conductive couplings is preferably electrically engaged with a corresponding one of the tracks associated with each of the support blocks respectively such that power is transmitted to each successive one of the support blocks. The conductive couplings may be engaged with a corresponding track such that they are electrically coupled to the tracks and thereby transmit power to each of the support blocks respectively. Additionally, each of the conductive couplings may remain statically positioned at a fixed location inside the support block while the ball bearings and the sockets are displaced along the travel paths.

In this fashion, the first one of the conductive cords may be directly coupled to the controller and power supply source while the second end of the first conductive cord is preferably freely displaced along an entire perimeter of the first one of the support blocks such that the controller is freely positioned at alternate locations surrounding the first support block while the support block remains static situated at a fixed location.

Each of the anterior surfaces of the support blocks preferably includes an opaque region for prohibiting light from penetrating outwardly therefrom. The numbers may be formed from transparent material and situated adjacent to the opaque region such that light is permitted to shine outwardly from the transparent material.

A method for exhibiting a customized address number display system in a variety of orientations may include a first step of providing and adjustably connecting a plurality of uniquely shaped mobile support blocks to each other. The method may include a second step of orienting the support blocks along a side-by-side orientation. Each of the mobile support blocks preferably includes an anterior side provided with a transparent number affixed thereto. The method may include a third step of providing and adjustably connecting first and second opposed ends of a plurality of conductive cords to adjacent ones of the support blocks.

Also, the method may include a fourth step of providing and communicatively coupling a controller to the conductive cords. Fifth, the method may include a step of simultaneously toggling each of the numbers between illuminated and non-illuminated modes based upon a corresponding user input at the controller. Finally, the method may include a sixth step of freely positioning the support blocks in alternate orientations while the numbers remain at the illuminated mode respectively by freely displacing the first and second opposed ends of the conductive cords along unique travel paths defined about respective perimeters of the support blocks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
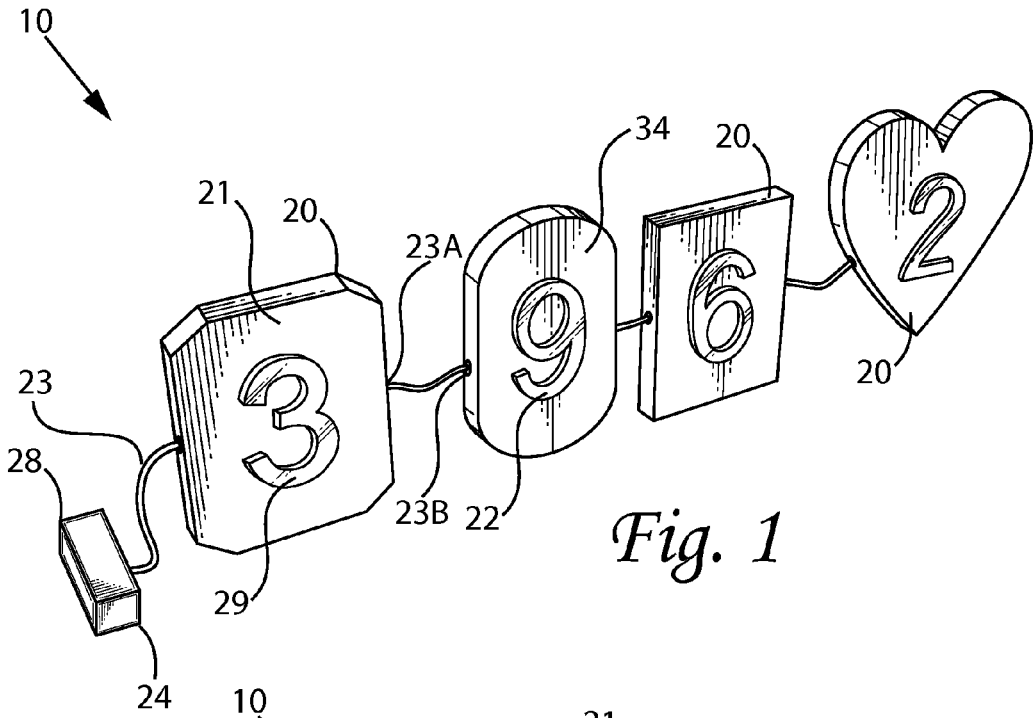
FIG. 1 is a perspective view showing an illuminable address display system, in accordance with the present invention.
Figure 2:
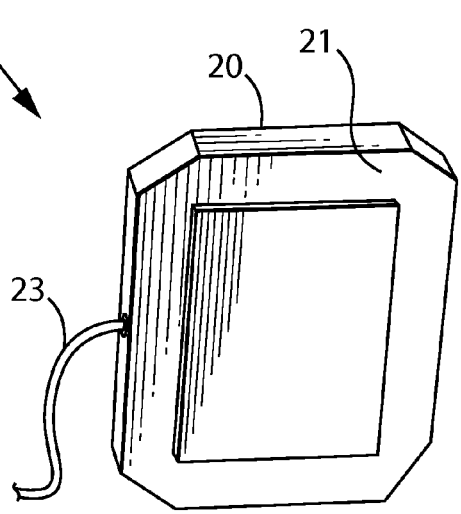
FIG. 2 is a perspective view showing a mobile support block with an attached conductive cord.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-7 by the reference numeral 10 and is intended to provide an illuminable address display system. It should be understood that the system 10 may be used to exhibit a customized address number in a variety of orientations and should not be limited in use to the applications mentioned herein. The illuminable address display system may be used to exhibit a customized address for a private residence or a commercial business, for example.

Referring initially to FIGS. 1-4, the illuminable address display system 10 may include a plurality of uniquely shaped mobile support blocks 20 adjustably connected to each other along a side-by-side orientation. Of course, such mobile support blocks 20 may be configured in alternate orientations, as explained below. Each of the mobile support blocks 20 preferably includes an anterior side 21 provided with a transparent number 22 affixed thereto. The system 10 may also include plurality of conductive cords 23 with first 23A and second 23B opposed ends adjustably connected to adjacent ones of the support blocks 20. A controller 24 may be communicatively coupled to the conductive cords 23 in such a manner that each of the numbers 22 is simultaneously toggled between illuminated and non-illuminated modes based upon a corresponding user input at the controller 24.

The combined elements of the controller 24 attached to conductive cords 23 provide a benefit wherein the user may toggle the numbers to an illuminated mode when the user wishes for their address to be seen at night. On the other hand, the user may also toggle the number to a non-illuminated mode when the user wishes to conserve electricity. This feature overcomes problems associated with prior art. Other inventions in the field, such as those with a light sensor for automatically toggling the address numbers to an illuminated mode at night, may fail to timely illuminate the numbers. In such prior art, the user's address may not be observable during twilight. However, with the present invention, the user does not have to depend on automatic sensors and may choose when and how long the system is in an illuminated mode.

Figure 3:
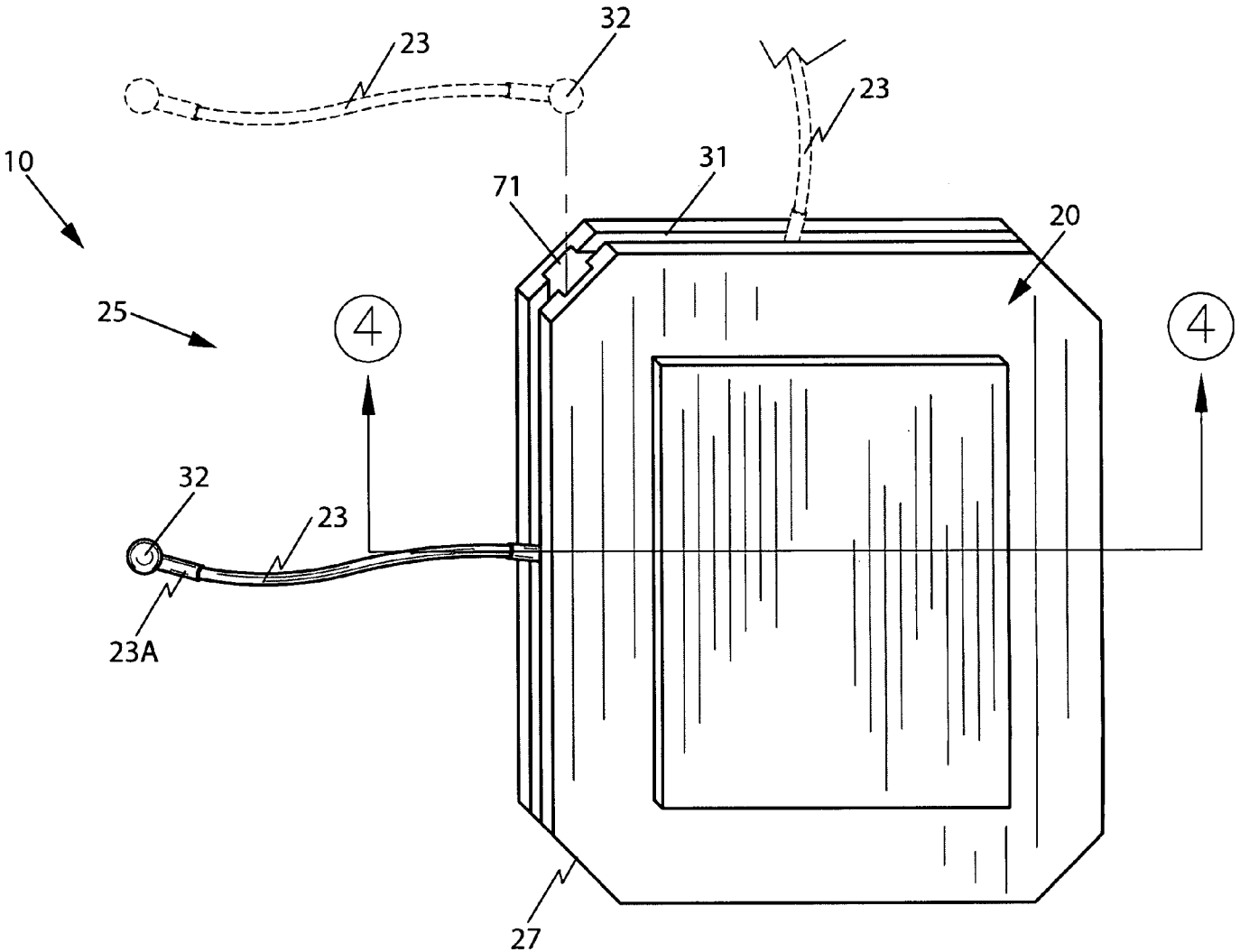
FIG. 3 is an enlarged perspective view of the mobile support block in FIG. 2 showing a detail of the conductive cord being inserted or removed from the track through an ingress egress orifice.
Figure 4:
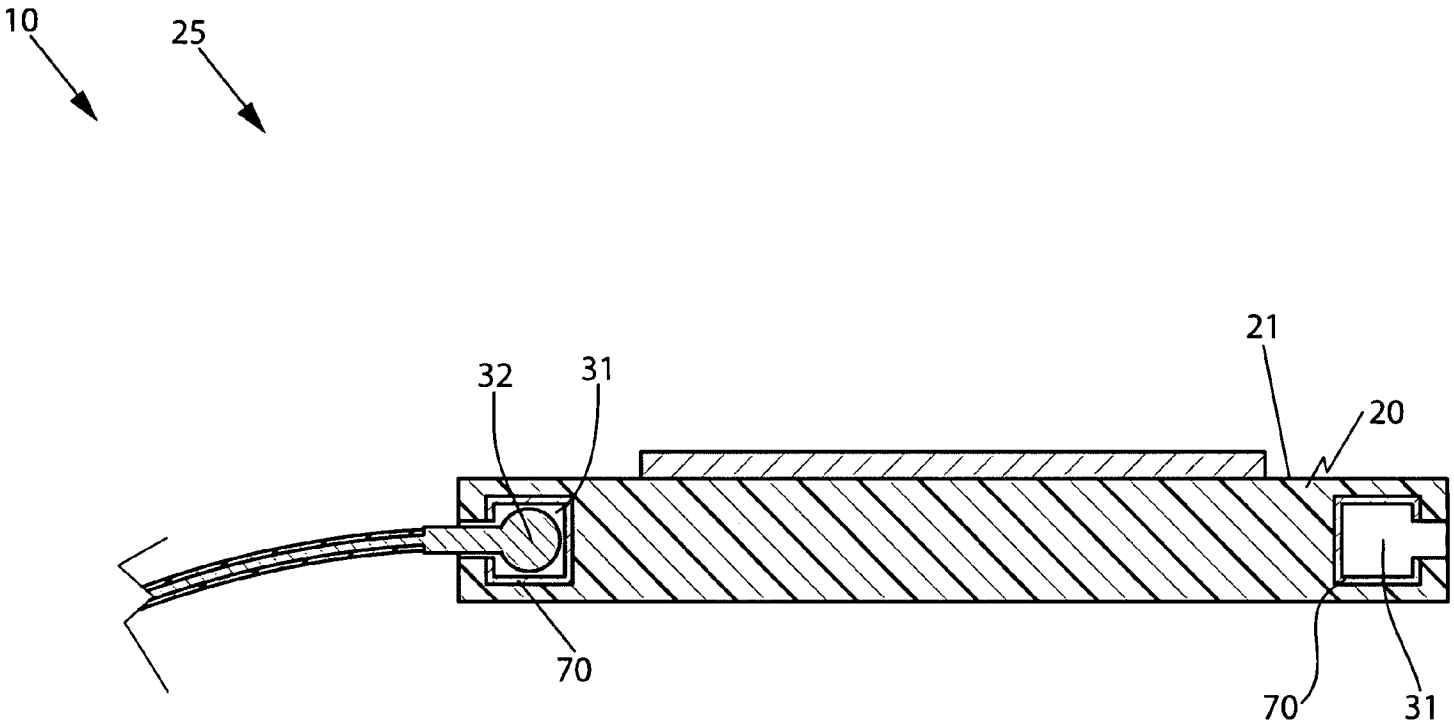
FIG. 4 is a cross section of the mobile support block showing a ball bearing of an opposed end of the conductive cord seated within the socket and track, taken along line 4-4, from FIG. 3.

Referring to FIGS. 3 and 4, the system 10 may further include a mechanism 25 for freely displacing the first 23A and second 23B opposed ends of the conductive cords 23 along unique travel paths defined about respective perimeters 27 of the support blocks 20 so that the support blocks 20 are freely positioned in alternate orientations while the numbers 22 remain at the illuminated mode respectively. This enables a user to adapt the illuminable address display system 10 to fit a wide variety of spaces. For example, the user may install the system 10 vertically along a front porch support post, horizontally over a front door, or diagonally along an arching window.

Figure 5:
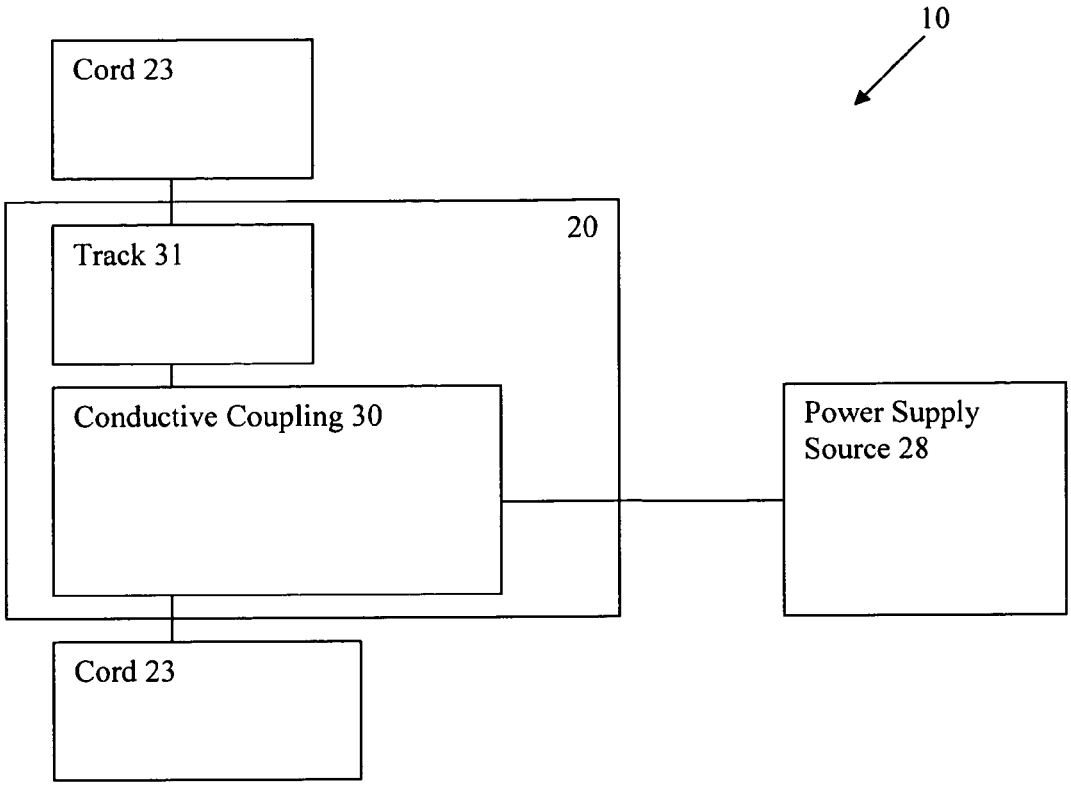
FIG. 5 is a schematic block diagram showing the electronic connection between the conductive cord, the track, and a conductive coupling respectively, in accordance with the present invention.

Referring to FIGS. 1 and 5, each support block 20 preferably includes a power supply source 28 electrically coupled to the controller 24 respectively. Also, each of the support blocks 20 may include a light-emitting member 29 electrically coupled to the power supply source 28. The power supply source 28 enables the user to install the system 10 in areas that lack an electrical outlet.

However, one skilled in the art recognizes that alternate embodiments of the present invention may include at least one conductive cord 23 with an attached power plug. Such a light-emitting member may be electrically engaged with a conductive coupling 30. Such a conductive coupling 30 may be preferably electrically engaged with adjacent ones of the conductive cords 23 which is important such that power is continuously transferred to adjacent ones of the light-emitting members 29 while the adjacent conductive cords 23 are displaced along the travel paths 26 respectively. In this manner, the user may configure the support blocks 20 into different orientations while the light-emitting members and the numbers 22 remain illuminated.

Referring to FIGS. 3, 4, and 5, the conductive cord displacing mechanism 25 preferably includes a plurality of tracks 31 formed about the perimeters 27 of the support blocks 20 respectively. A plurality of ball bearings 32 may be attached directly to the opposed first 23A and second 23B ends of the conductive cords 23 respectively such that a pair of ball bearings 32 is simultaneously situated along each of the tracks 31. Furthermore, each track 31 preferably includes at least one ingress egress orifice 71. Such an ingress egress orifice is 71 is important so that the user may detach the conductive cord 23 from the supporting block 20 by removing the ball bearing 32 through the ingress egress orifice 71. In addition, a plurality of sockets 70 may be slidably connected to the tracks 31 respectively such that a pair of the sockets 70 is preferably simultaneously positioned in each of the tracks 31. Advantageously, the ball bearings 32 may be rotatably interfitted within the sockets 70 in such a manner that each of the conductive cords 23 are synchronously displaced along the associated tracks 31 respectively.

These features enable the user to configure the supporting blocks 20 into different configurations by either removing then reattaching the conductive cords 23 through the ingress egress orifices 71 or by rotating the conductive cords 23 along the tracks 31 with the ball bearings 32.

Referring to FIGS. 3, 4, and 5, the conductive cord displacing mechanism 25 may further include the plurality of conductive couplings 30 situated within the support blocks 20 respectively. Each of such conductive couplings 30 is preferably electrically engaged with a corresponding one of the tracks 31 associated with each of the support blocks 20 respectively such that power is transmitted to each successive one of the support blocks 20.

The conductive couplings 30 may be engaged with a corresponding track 31 such that they are electrically coupled to the tracks 31 and thereby transmit power to each of the support blocks 20 respectively. Additionally, each of the conductive couplings 30 may remain statically positioned at a fixed location inside the support block 20 while the ball bearings 32 and the sockets 70 are displaced along the travel paths 26. The combined elements of the conductive couplings 33 and the conductive cords 23 provide an unexpected benefit wherein the user may arrange the support blocks 20 in a wide variety of configurations without being hindered by a continuous electric cord.

In this fashion, the first one of the conductive cords 23 may be directly coupled to the controller 24 and power supply source 28 while the second end 23B of the first conductive cord 23 is preferably freely displaced along an entire perimeter 27 of the first one of the support blocks 20 such that the controller 24 is freely positioned at alternate locations surrounding the first support block 20 while the support block 20 remains statically situated at a fixed location. One skilled in the art understands various orientations and configurations are possible by slidably guiding the cords 23 along the circumferences of the support blocks 20 respectively.

Now referring to FIG. 1, each of the anterior surfaces 21 of the support blocks 20 preferably includes an opaque region 34 for prohibiting light from penetrating outwardly therefrom. The numbers 22 may be formed from transparent material and situated adjacent to the opaque region 34 such that light is permitted to shine outwardly from the transparent material.

In use, a method for exhibiting a customized address number display system 10 in a variety of orientations may include a first step of providing and adjustably connecting a plurality of uniquely shaped mobile support blocks 20 to each other. The method may include a second step of orienting the support blocks 20 along a side-by-side orientation. Each of the mobile support blocks 20 preferably includes an anterior 21 side provided with a transparent number 22 affixed thereto. The method may include a third step of providing and adjustably connecting first 23A and second 23B opposed ends of a plurality of conductive cords 23 to adjacent ones of the support blocks 20.

Also, the method may include a fourth step of providing and communicatively coupling a controller 24 to the conductive cords 23. Fifth, the method may include a step of simultaneously toggling each of the numbers 22 between illuminated and non-illuminated modes based upon a corresponding user input at the controller 24. Finally, the method may include a sixth step of freely positioning the support blocks 20 in alternate orientations while the numbers 22 remain at the illuminated mode respectively by freely displacing the first 23A and second 23B opposed ends of the conductive cords 23 along unique travel paths 26 defined about respective perimeters 27 of the support blocks 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An illuminable address display system for exhibiting a customized address number in a variety of orientations, said illuminable address display system comprising:

a plurality of mobile support blocks adjustably connected to each other along a side-by-side orientation, each of said mobile support blocks having an anterior side provided with a transparent number affixed thereto;

a plurality of conductive cords having first and second opposed ends adjustably connected to adjacent ones of said support blocks;

a controller communicatively coupled to said conductive cords in such a manner that each of said numbers are simultaneously toggled between illuminated and non-illuminated modes based upon a corresponding user input at said controller;

means for freely displacing said first and second opposed ends of said conductive cords along unique travel paths defined about respective perimeters of said support blocks so that said support blocks are freely positioned in alternate orientations while said numbers remain at the illuminated mode respectively;

wherein each of said support blocks comprises a power supply source electrically coupled to said controller respectively;

a light-emitting member electrically coupled to said power supply source; and a conductive coupling electrically engaged with said light-emitting member and adjacent ones of said conductive cords in such a manner that power is continuously transferred to adjacent ones of said light-emitting members while a said adjacent conductive cords are displaced along said travel paths respectively;

wherein said conductive cord displacing means comprises a plurality of tracks formed about said perimeters of said support blocks respectively;

a plurality of ball bearings attached directly to said opposed first and second ends of said conductive cords respectively such that a pair of said ball bearings are simultaneously situated along each of said tracks; and a plurality of sockets slidably connected to said tracks respectively such that a pair of said sockets are simultaneously positioned in each of said tracks;

wherein said ball bearings are rotatably interfitted within said sockets in such a manner that each of said conductive cords and said support blocks are synchronously displaced along said associated tracks respectively.

2. The illuminable address display system of claim 1, wherein said conductive cord displacing means comprises:

a plurality of conductive couplings situated within said support blocks respectively, each of said conductive couplings being electrically engaged with a corresponding one of said tracks associated with each of said support blocks respectively such that power is transmitted to each successive one of said support blocks respectively;

wherein said conductive couplings are electrically coupled to said tracks and thereby transmit power to each of said support blocks respectively.

3. The illuminable address display system of claim 2, wherein each of said anterior surfaces has an opaque region for prohibiting light from penetrating outwardly therefrom, said numbers being formed from transparent material and situated adjacent to said opaque region such that light is permitted to shine outwardly from said transparent material.

4. The illuminable address display system of claim 1, wherein each of said conductive couplings remain statically positioned at a fixed location inside said support block while said ball bearings and said sockets are displaced along said travel paths.

5. The illuminable address display system of claim 4, wherein a first one of said conductive cords is directly coupled to said controller, said second end of said first conductive cord being freely displaced along an entire perimeter of a first one of said support blocks such that said controller is freely positioned at alternate locations surrounding said first support block while said support block remains static situated at a fixed location.

6. An illuminable address display system for exhibiting a customized address number in a variety of orientations, said illuminable address display system comprising:

a plurality of uniquely shaped mobile support blocks adjustably connected to each other along a side-by-side orientation, each of said mobile support blocks having an anterior side provided with a transparent number affixed thereto;

a plurality of conductive cords having first and second opposed ends adjustably connected to adjacent ones of said support blocks;

a controller communicatively coupled to said conductive cords in such a manner that each of said numbers are simultaneously toggled between illuminated and non-illuminated modes based upon a corresponding user input at said controller;

means for freely displacing said first and second opposed ends of said conductive cords along unique travel paths defined about respective perimeters of said support blocks so that said support blocks are freely positioned in alternate orientations while said numbers remain at the illuminated mode respectively;

wherein each of said support blocks comprises a power supply source electrically coupled to said controller respectively;

a light-emitting member electrically coupled to said power supply source; and a conductive coupling electrically engaged with said light-emitting member and adjacent ones of said conductive cords in such a manner that power is continuously transferred to adjacent ones of said light-emitting members while a said adjacent conductive cords are displaced along said travel paths respectively;

wherein said conductive cord displacing means comprises a plurality of tracks formed about said perimeters of said support blocks respectively;

a plurality of ball bearings attached directly to said opposed first and second ends of said conductive cords respectively such that a pair of said ball bearings are simultaneously situated along each of said tracks; and a plurality of sockets slidably connected to said tracks respectively such that a pair of said sockets are simultaneously positioned in each of said tracks;

wherein said ball bearings are rotatably interfitted within said sockets in such a manner that each of said conductive cords and said support blocks are synchronously displaced along said associated tracks respectively.

7. The illuminable address display system of claim 6, wherein said conductive cord displacing means comprises:

a plurality of conductive couplings situated within said support blocks respectively, each of said conductive couplings being electrically engaged with a corresponding one of said tracks associated with each of said support blocks respectively such that power is transmitted to each successive one of said support blocks respectively;

wherein said conductive couplings are electrically coupled to said tracks and thereby transmit power to each of said support blocks respectively.

8. The illuminable address display system of claim 7, wherein each of said anterior surfaces has an opaque region for prohibiting light from penetrating outwardly therefrom, said numbers being formed from transparent material and situated adjacent to said opaque region such that light is permitted to shine outwardly from said transparent material.

9. The illuminable address display system of claim 6, wherein each of said conductive couplings remain statically positioned at a fixed location inside said support block while said ball bearings and said sockets are displaced along said travel paths.

10. The illuminable address display system of claim 9, wherein a first one of said conductive cords is directly coupled to said controller, said second end of said first conductive cord being freely displaced along an entire perimeter of a first one of said support blocks such that said controller is freely positioned at alternate locations surrounding said first support block while said support block remains static situated at a fixed location.

* * * * *